US007854276B2

(12) United States Patent
Cooper et al.

(10) Patent No.: US 7,854,276 B2
(45) Date of Patent: Dec. 21, 2010

(54) METHODS, SYSTEMS, AND APPARATUS FOR PRODUCTION OF HYDROCARBONS FROM A SUBTERRANEAN FORMATION

(75) Inventors: Iain Cooper, Sugar Land, TX (US); Rex Burgos, Stafford, TX (US); Patrick Schneider, Richmond, TX (US); John Styre, Grande Prairie (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/610,132

(22) Filed: Oct. 30, 2009

(65) Prior Publication Data

US 2010/0044101 A1 Feb. 25, 2010

(51) Int. Cl.

| | |
|---|---|
| ***E21B 7/04*** | (2006.01) |
| ***E21B 43/30*** | (2006.01) |
| ***E21B 29/02*** | (2006.01) |
| ***E21B 43/263*** | (2006.01) |

(52) U.S. Cl. ..... 175/61; 175/2; 166/50; 166/52; 166/63; 166/245; 166/299

(58) Field of Classification Search ..... 175/2, 175/61, 4.57; 166/50, 52, 245, 63, 299
See application file for complete search history.

(56) References Cited

U.S. PATENT DOCUMENTS

| | | | |
|---|---|---|---|
| 3,771,600 | A | 11/1973 | Hill |
| 4,223,734 | A | 9/1980 | Lekas |
| 6,015,015 | A | 1/2000 | Luft et al. |
| 6,024,169 | A | 2/2000 | Haugen |
| 6,106,733 | A | 8/2000 | Wood |
| 6,390,191 | B1 | 5/2002 | Melson et al. |
| 7,063,145 | B2 | 6/2006 | Veenstra |
| 7,191,842 | B2 | 3/2007 | Hackworth |
| 2004/0177972 | A1 | 9/2004 | Hackworth et al. |
| 2005/0087340 | A1 | 4/2005 | Zupanick et al. |
| 2005/0241834 | A1 | 11/2005 | McGlothen et al. |
| 2006/0124360 | A1 | 6/2006 | Lee |
| 2007/0175638 | A1 | 8/2007 | Crichlow |

OTHER PUBLICATIONS

Gates, C.F. and Holmes, B.G.: "Thermal Well Completions and Operation", Proc. 7th World Petroleum Conf., paper PD-11, 1967, pp. 419-429.

Curtis, C. et al., "Heavy-Oil Reservoirs", Oilfield Review, Autumn 2002, pp. 30-51.

Earlougher, R.C.: "Some Practical Considerations in the Design of Steam Injection Wells", paper SPE 2202, 1969.

Chu. C.: "State-of-the-Art Review of Steamflood Field Projects", paper SPE 11733, 1985.

Butler, R.M.: "Application of SAGD, Related Processes Growing in Canada", Oil & Gas J. (2001) May 14, pp. 74-78.

(Continued)

*Primary Examiner*—Giovanna C Wright
(74) *Attorney, Agent, or Firm*—Jay P. Sbrollini; Wayne I. Kanak

(57) ABSTRACT

Methods, systems, and apparatus that are suitable for use in production of hydrocarbons from subterranean heavy oil deposits employ a subterranean cavity in communication with a borehole. The cavity is preferably formed along a U-tube borehole by coiled tubing reaming operations and/or radial drilling and explosive blasting.

18 Claims, 4 Drawing Sheets

OTHER PUBLICATIONS

Butler, R.M.: "SAGD Comes of Age", J. of Canadian Petrol. Tech., 37(7); (1988) pp. 9-12.

Dobson, W.F., Conoco Inc.; Seelye, D.R., Conocco Inc.: "Mining Technology Assists Oil Recovery from Wyoming Field", paper SPE 9418,1982.

Harding, T.G., BP Exploration Canada; Farouq Ali, S.M., U of Alberta: "Mine-Assisted Heavy Oil Recovery Technology", paper SPE 12787,1984.

Lyman, T.J., Piper, E.M., Rydell, A.W., Stone and Webster Engineering Corp.: "Heavy Oil Mining Technical and Economic Analysis", paper SPE 12788, 1984.

METHODS, SYSTEMS, AND APPARATUS FOR PRODUCTION OF HYDROCARBONS FROM A SUBTERRANEAN FORMATION

BACKGROUND OF THE INVENTION

1. Field of the Invention

This invention relates to methods, systems, and apparatus for the production of hydrocarbons from a subterranean formation.

2. Description of Related Art

Heavy oil from tar sand and bitumen deposits comprise significant resources for hydrocarbons to the extent that they can be economically produced. Typically, such heavy oil is heated to reduce the oil or mineral viscosity before it will flow, or to enhance flow. The predominant method for heating heavy oil is the injection of a hot fluid from the surface. One common industry practice typically referred to as "steam flooding" is carried out by injecting steam through a designated injection well in order to heat the surrounding hydrocarbons, which are produced simultaneously from one or more nearby production wells. An alternate commercial practice typically referred to as "cyclic steam stimulation" is carried out by intermittently injecting steam into a production well.

During the last decade, the steam-assisted gravity drainage (SAGD) method for recovering heavy oil has been extensively developed and is now the most common technique utilized for heavy oil production in Canada. The process utilizes twin horizontal wells drilled and extended into the base of a reservoir with the horizontal steam injector placed directly above the horizontal production well. In an ideal SAGD process, a growing steam chamber forms around the horizontal injector, and steam flows continuously to the perimeter of the chamber, where it condenses and heats the surrounding oil. As the viscosity of the oil decreases, it drains to the horizontal production well underneath. Thus, the use of gravity increases the efficiency of oil production.

Such thermal stimulation methodologies are limited in their effectiveness and efficiency in many operating environments.

BRIEF SUMMARY OF THE INVENTION

It is therefore an object of the present invention to provide methods, systems, and apparatus that are suitable for use in production of hydrocarbons from subterranean heavy oil deposits and that have improved effectiveness and efficiencies.

It is another object of the invention to provide methods, systems, and apparatus for production of hydrocarbons from subterranean formations that provide improved effectiveness and efficiencies in other applications.

In accord with these objects, which will be discussed in detail below, production of hydrocarbons is carried out employing a U-tube borehole with one or more enlarged cavities extending along the length of the U-tube borehole. The U-tube borehole may be drilled using any suitable drilling apparatus and/or method. For example, a U-tube borehole may be drilled using rotary drilling tools, percussive drilling tools, or jetting tools. In the preferred embodiment, the U-tube borehole is drilled utilizing two coiled tubing drilling rigs from two surface locations. One or more enlarged cavities are formed along the length of the U-tube borehole. In the preferred embodiment, the enlarged cavity(ies) are disposed along a horizontal section of the U-tube borehole.

The enlarged cavity(ies) can be formed by a rotary underreamer with radial-extendable cutting members as is well known in the art. In an illustrative embodiment, a bidirectional reaming device as described herein can be used to form the enlarged cavity(ies) along the length of the U-tube borehole. The bidirectional reaming tool is suspended in the U-tube borehole by coiled tubing deployed by two coiled tubing rigs. The tool includes two sets of cutting bits that are rotationally driven by corresponding mud motors. The sets of cutting bits are extendable radially with respect to the housing of the tool. The mud motors and the cutting bits are preferably operated in an alternating manner such that the tool is moved back and forth in opposite directions along a section of the U-tube borehole in order to create the enlarged cavity along the length of the U-tube borehole. Drilling fluid can be circulated to the tool in a dual circular configuration as described herein. The drilling fluid serves as a lubricant for the cutting bits and as a carrying medium for the cuttings produced by the cutting bits.

As a supplement to (or in lieu of) these reaming operations, a number of child boreholes can be drilled in a pattern that extends radially away from the parent U-tube borehole. The child borehole pattern can be formed with a template guide as described herein. Explosive charges can be placed at or near the end of one or more of the child boreholes and then triggered to form an area of rubble around the U-tube borehole. The bidirectional reaming tool as described herein (or another reaming tool) can be used to break the rubble into smaller fragments and carry such fragments to the surface. These reaming operations could also be enhanced by the use of jetting or hydromining that fluidizes the produced fragments and hence eases transport to the surface. The removal of the fragments forms an enlarged cavity that extends radially outward along a length of the U-tube borehole. In the preferred embodiment, the enlarged cavity is formed along a horizontal section of the U-tube borehole.

One or more expandable support members can be deployed into the enlarged cavity(ies) formed as described herein for stability. In the preferred embodiment, the expandable support member is loaded into coiled tubing in a collapsed configuration and deployed from the coiled tubing within a cavity where it expands radially into an expanded configuration that butts up against the wall of the cavity. In the expanded configuration, the support member supports radial loads and thus provides stability to the cavity while providing a central flow path for the flow of drilling fluids and production fluids therethrough.

The U-tube borehole with one or more enlarged cavities as described herein can be used for thermal recovery of heavy oil deposits. In one example, the U-tube borehole with one or more enlarged cavities can be used as an injector well for steam flooding and/or other vapor-assisted production applications. In another example, the U-tube borehole with one or more enlarged cavities can be used as a production well for steam flooding and/or other vapor-assisted production applications. In yet another example, the U-tube borehole with one or more enlarged cavities can be used as a well for cyclic vapor stimulation where the well is used to inject steam and/or other high temperature vapor into a surrounding heavy oil deposit for a short period of time and then returned to production.

It is possible for the fragments that are removed from the U-tube borehole to be phase separated to thereby extract oil and water and possibly unwanted drilling fluids from the fragments. The resulting tailings can be used to backfill the enlarged cavity(ies) and other parts of the U-tube borehole as needed, thereby implementing a closed loop processing system for the fragments of the U-tube borehole.

The methodologies, systems and apparatus as described above can be used for other hydrocarbon applications. For example, the methods and apparatus for borehole enlargement can be used to form enlarged cavities that extend radially from a vertical borehole section or other type borehole section.

Additional objects and advantages of the invention will become apparent to those skilled in the art upon reference to the detailed description taken in conjunction with the provided figures.

DETAILED DESCRIPTION OF THE INVENTION

For the purposes of this specification, a U-tube borehole is a borehole which includes two separate surface locations that are connected by at least one subterranean path. The U-tube borehole may follow any path between the two surface locations (it being appreciated that the surface locations may be at different altitudes). In other words, the U-tube borehole may be "U-shaped" but is not necessarily U-shaped.

The direction of a borehole can be represented by a vertical component (a magnitude in the vertical direction) and a horizontal component (a magnitude in a horizontal direction orthogonal to the vertical direction). A vertical borehole is a borehole or borehole section that extends in a direction with a vertical component significantly greater than a horizontal component. A horizontal borehole is a borehole or borehole section that extends in a direction with a horizontal component significantly greater than a vertical component.

In accordance with the present invention, production of hydrocarbons is carried out employing a U-tube borehole with one or more enlarged cavities extending along the length of the U-tube borehole. The U-tube borehole may be drilled using any suitable drilling apparatus and/or method. For example, a U-tube borehole may be drilled using rotary drilling tools, percussive drilling tools, or jetting tools. In the preferred embodiment, the U-tube borehole is drilled utilizing coiled tubing as described below in more detail. Alternatively, jointed drill pipe or composite drill pipe can be used. Rotary drilling tools for use in drilling U-tube boreholes may include roller cone bits or polycrystalline diamond cutter (PDC) bits.

Steering of the drill string during drilling may be accomplished by using any suitable steering technology, including steering tools associated with downhole motors, rotary steerable tools, or coiled tubing orientation devices in conjunction with positive displacement motors, turbines, vane motors, or other bit rotation devices.

Combinations of apparatus and/or methods may also be used in order to drill a U-tube borehole. Drill strings and pipe incorporating the drilling apparatus may include ancillary components such as measurement-while-drilling (MWD) tools, non-magnetic drill collars, stabilizers, or reamers.

The U-tube borehole may be drilled as a single borehole from a first end at a first surface location to a second end at a second surface location. Alternatively, the U-tube borehole may be drilled as two separate but intersecting boreholes as described in detail in U.S. Patent Application Publication No. 2006/0124360, incorporated by reference in its entirety.

Figure 1:
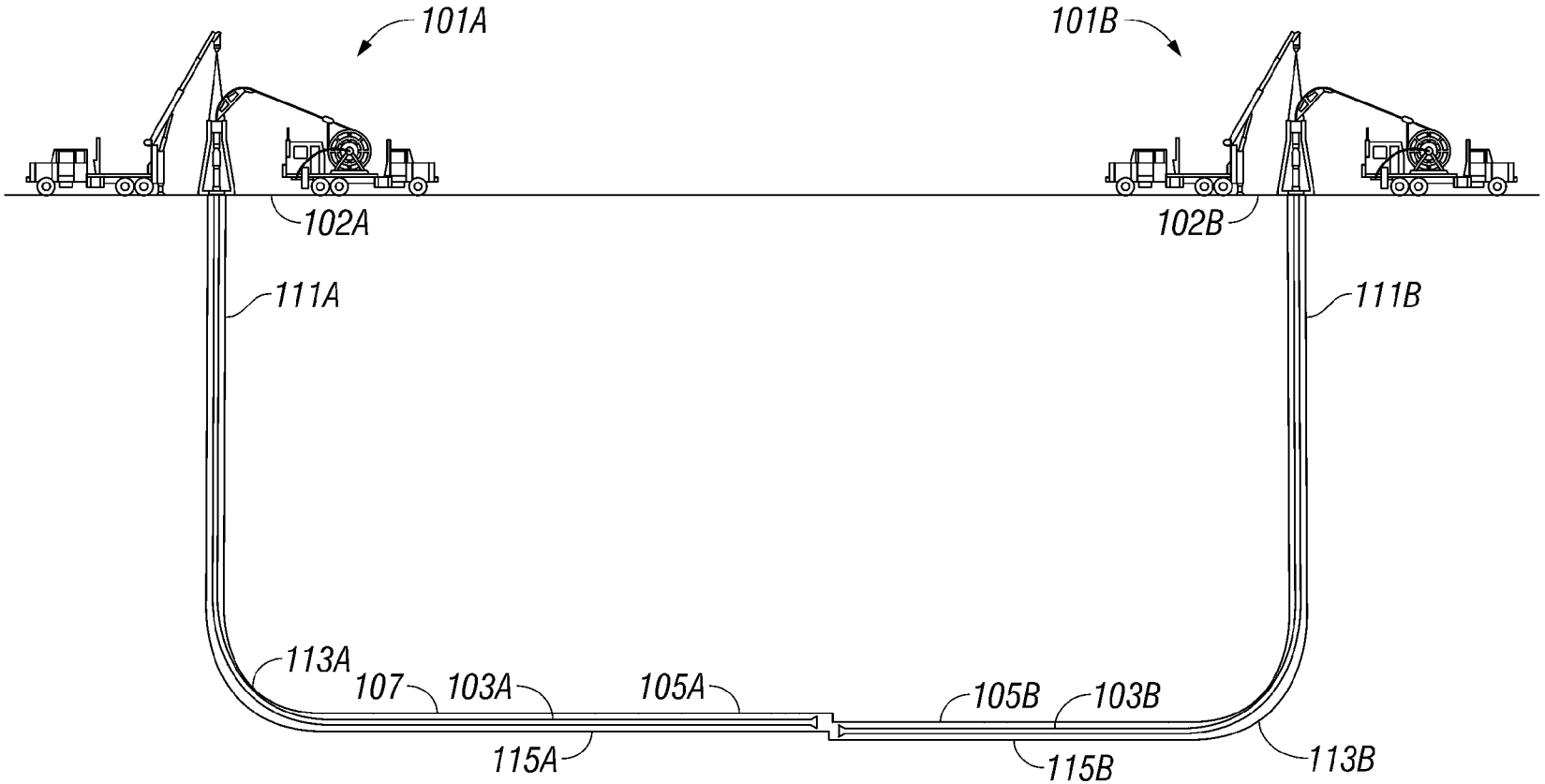
FIG. 1 is a schematic diagram illustrating the drilling operations of a U-tube borehole in accordance with the present invention.

In the preferred embodiment, the U-tube borehole is drilled utilizing two coiled tubing drilling rigs from two surface locations as shown in FIG. 1. Coiled tubing comprises a continuous length of uniform outer diameter tubing (typically several hundred to several thousand feet), which is capable of being repeatedly coiled and uncoiled from a truckable spool, and which is capable of being repeatedly inserted into and withdrawn from the borehole. The continuous lengths are typically, although not necessarily, manufactured of steel having a longitudinally welded seam. The coiled tubing rigs include coiled tubing injectors which are capable of running and operating the coiled tubing within the borehole. For drilling purposes, a bottomhole assembly that includes a mud motor and drill bit are suspended from the coiled tubing. Drilling fluid is supplied to the mud motor, which converts the hydraulic power carried by the drilling fluid into rotation that rotationally drives the drill bit. Fluid can also be passed through the coiled tubing for a variety of purposes, such as for lubricating the drill bit and for carrying cuttings produced by the drill bit back to the surface. Being flexible, coiled tubing is particularly useful for horizontal borehole applications as described herein. In the illustrative embodiment shown in FIG. 1, a coiled tubing rig 101A located at a first surface location 102A is operated to deploy coiled tubing 103A and drill a first segment 105A as shown. A second coiled tubing rig 101B located at a second surface location 102B is operated to deploy coiled tubing 103B and drill a second segment 105B. The first and second segments 105A, 105B intersect one another to thereby realize a U-tube borehole 107 extending between the first and second surface locations 102A, 102B. One or more parts of the first segment 105A and/or one or more parts of the second segment 105A can be lined or cased or otherwise stabilized, if needed. As depicted in FIG. 1, the first segment 105A includes a vertical section 111A extending to a curved section 113A (typically referred to as a "heel" section), which extends to a horizontal section 115A (typically referred to as a "toe" section). Similarly, the second segment 105B includes a vertical section 111B extending to a curved section 113B (typically referred to as a "heel" section), which extends to a horizontal section 115B (typically referred to as a "toe" section). The ends of the horizontal sections 115A, 115B intersect one another to realize a "toe-to-toe" intersection. Other configurations are possible. For example, the horizontal section 115B can intersect the horizontal section 115A along any part of the horizontal section 115A. In another example, the horizontal section 115A can intersect the horizontal section 115B along any part of the horizontal section 115B. In yet another example, horizontal section 115A can intersect curved section 113B or vertical section 111B, or horizontal section 115B can intersect curved section 113A or vertical section 111A.

One or more enlarged cavities are formed along the length of the U-tube borehole 107. In the preferred embodiment, the enlarged cavity(ies) are disposed along the horizontal section (115A, 115B) of the U-tube borehole 107. The enlarged cavity(ies) can be formed by a rotary underreamer with radially-extendable cutting members as is well known in the art. The cutting members can be extended radially outward by hydraulic means, by mechanical means (e.g., a wedge-shaped actuator or other linkage actuator), by centrifugal forces caused by rotation of the device, or by other suitable means. Other means can be used to realize the enlarged cavity(ies).

Figure 2A:
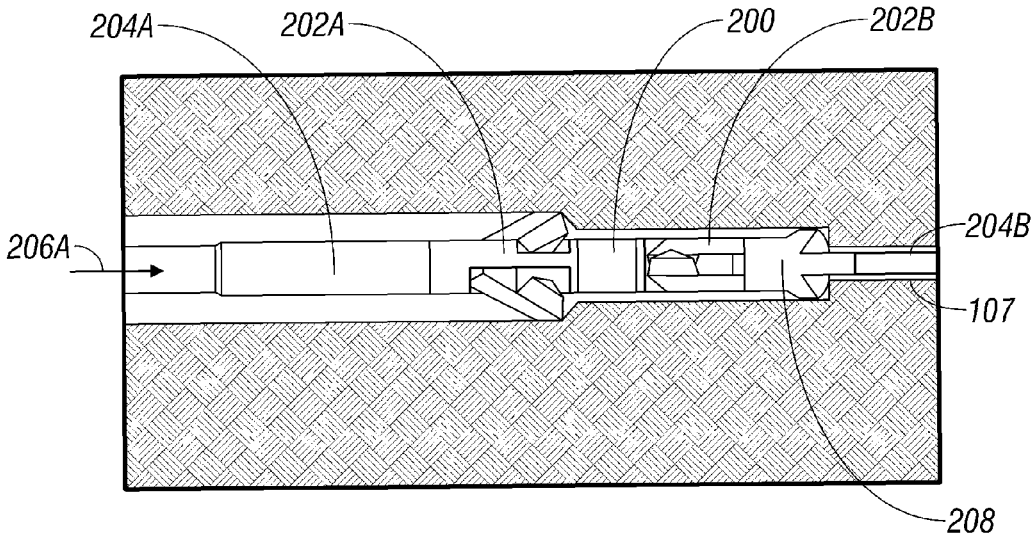
FIGS. 2A and 2B are schematic diagrams illustrating a bidirectional reaming tool for reaming a section of the U-tube borehole of FIG. 1.
Figure 2B:
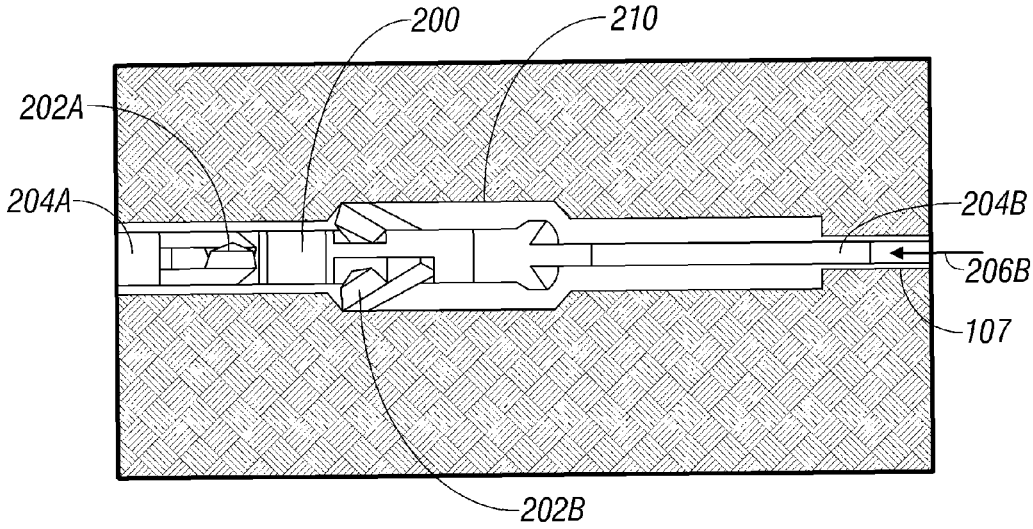
Figure 3:
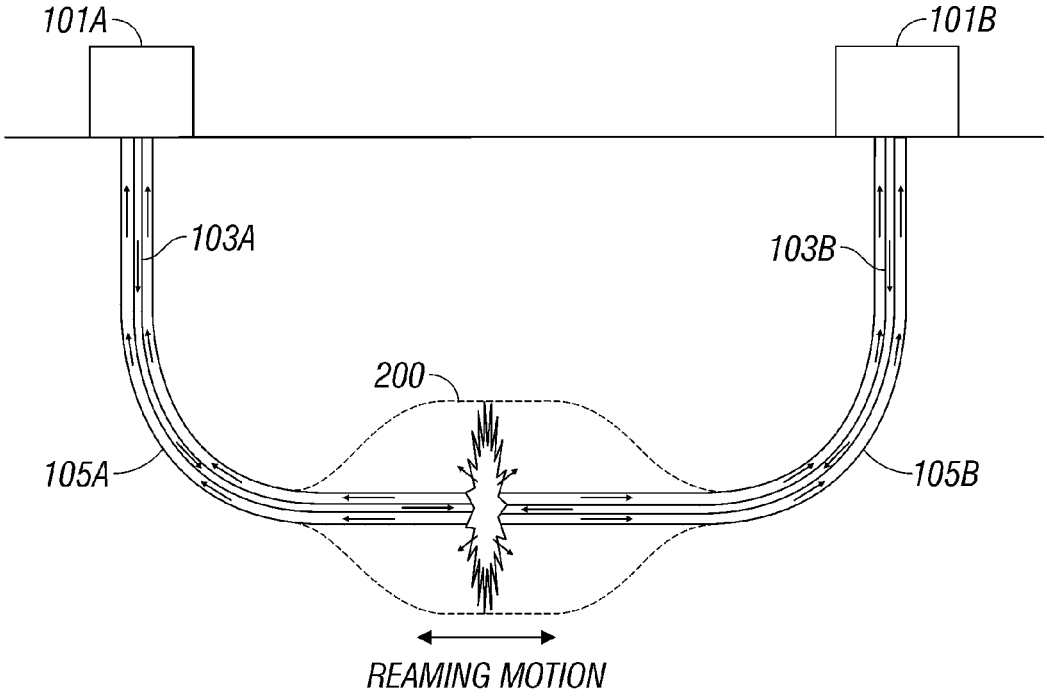
FIG. 3 is a schematic illustration of drilling fluid circulation that can be used in conjunction with the reaming tool of FIGS. 2A and 2B in accordance with the present invention.

In an illustrative embodiment, a bidirectional reaming device as shown in FIGS. 2A and 2B is used to form one or more enlarged cavities (one shown as 210) along the length of the U-tube borehole 107. The bidirectional reaming tool 200 is suspended in the U-tube borehole 107. One end of the reaming tool 200 is coupled to the coiled tubing deployed by coiled tubing rig 101A and the other end of the reaming tool 200 is coupled to coiled tubing deployed by coiled tubing rig 101B similar to the configuration shown in FIG. 1. The reaming tool 200 includes two sets of cutting bits 202A, 202B that are rotationally driven by corresponding mud motors 204A, 204B. The sets of cutting bits 202A, 202B are extendable radially with respect to the housing of the reaming tool 200 by hydraulic means, by mechanical means (e.g., a wedge-shaped actuator or other linkage actuator), by centrifugal forces caused by rotation of the device, or by other suitable means. The mud motor 204A is operated by hydraulic pressure supplied by the coiled tubing deployed from coiled tubing rig 101A. The mud motor 204B is operated by hydraulic pressure supplied by the coiled tubing deployed from coiled tubing rig 101B. The coiled tubing rigs 101A, 101B preferably apply axial forces to the reaming tool 200 to control movement of the tool along the length of the U-tube borehole. Downhole thrusters can be used to aid in applying such axial forces as needed. A drill bit 208 can be provided to allow for reaming operations for clearance of the tool if needed. The mud motors 204A, 204B and the cutting bits 202A, 202B are preferably operated in an alternating manner such that the reaming tool 200 is moved back and forth in opposite directions along a section of the U-tube borehole 107 in order to create the enlarged cavity 210 along the length of the U-tube borehole 107. FIG. 2A illustrates the operation of the mud motor 204A and cutting bits 202A whereby the cutting bits 202A are radially extended and rotated to cut into the formation along the U-tube borehole 107 as axial forces are applied to cutting bits 202A along direction 206A. During such operations, the cutting bits 202B are positioned in a retracted position and thus do not extend radially away from the tool toward the formation. FIG. 2B illustrates the operation of the mud motor 204B and cutting bits 202B whereby the cutting bits 202B are radially extended and rotated to cut into the formation along the U-tube borehole 107 as axial forces are applied to cutting bits 202B along direction 206B. During such operations, the cutting bits 202A are positioned in a retracted position and thus do not extend radially away from the tool toward the formation. During such borehole enlargement operations, drilling fluid is preferably circulated in a dual circular configuration as shown in FIG. 3. More specifically, drilling fluid is supplied down the coiled tubing sections 103A, 103B to operate the respective mud motors 204A, 204B and then injected adjacent the corresponding cutting bits 202A, 202B. The drilling fluid serves as a lubricant for the cutting bits and as a carrying medium for the cuttings produced by the cutting bits. The drilling fluid returns back to the respective surface locations 102A, 102B in the annulus between the borehole segments 105A, 105B and the coiled tubing sections 103A, 103B as shown.

Figure 4:
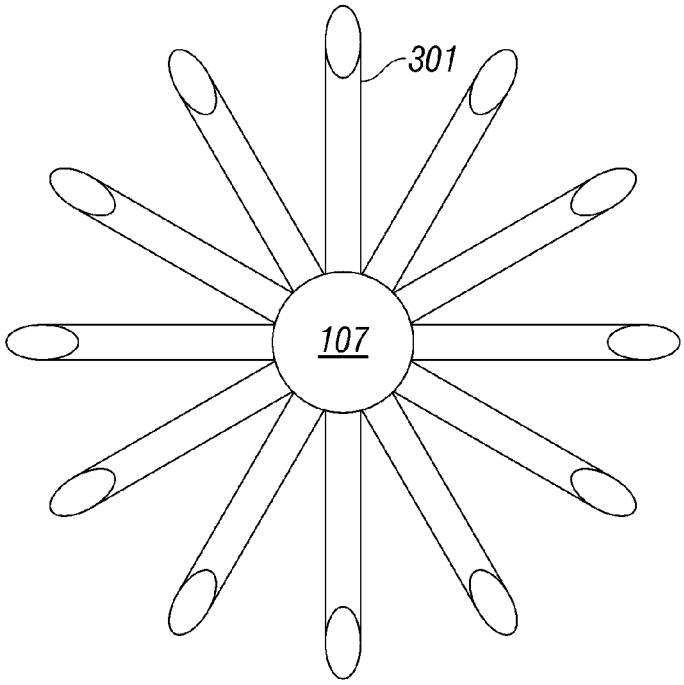
FIG. 4 is a schematic illustration of a pattern of child boreholes that can extend from a borehole section in accordance with the present invention.
Figure 5:
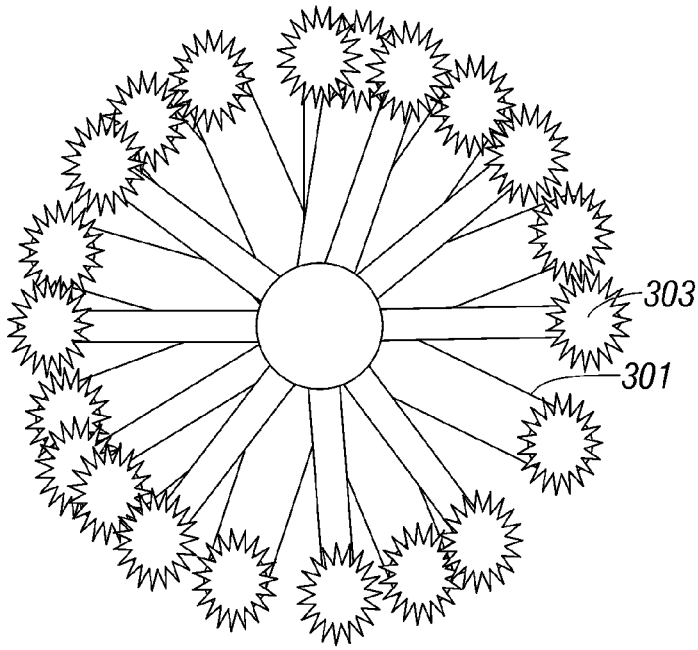
FIG. 5 is a schematic illustration of a pattern of child boreholes that can extend from a borehole section and explosive charges placed therein for creating a rubble zone around the borehole section.

As a supplement to (or in lieu of) the reaming operations discussed above, a number of child boreholes (for example, twelve labeled 301 as shown in FIG. 4) can be drilled in a pattern that extends radially away from the U-tube borehole 107. The child boreholes of the pattern (labeled 301') can overlap one another as shown in FIG. 5. The child boreholes can extend radially away from the U-tube borehole 107 in a plane generally transverse to the U-tube borehole 107. The child boreholes can also extend radially away from the U-tube borehole 107 in a three dimensional pattern whereby the child boreholes do not lie in such a transverse plane. Explosive charges 303 can be placed at or near the end of one or more of the child boreholes as shown in FIG. 5. The explosive charges are triggered to form an area of rubble around the U-tube borehole 107. The triggering of the explosive charges can occur simultaneously, in sequence, or a combination of both. The layout of the pattern of child boreholes, as well as the triggering sequence of explosive charges therein, if used, can be dictated by geomechanical modeling in order to optimize stability. The bidirectional reaming tool 200 as described above (or another reaming tool) can be used to break the rubble into smaller fragments and carry such fragments to the surface. These reaming operations can also be enhanced by the use of jetting or hydromining that fluidizes the produced fragments and hence eases transport to the surface. The removal of the fragments forms an enlarged cavity that extends radially outward along a length of the U-tube borehole 107. In the preferred embodiment, the enlarged cavity is formed along the horizontal sections (115A, 115B) of the U-tube borehole 107.

Figure 6:
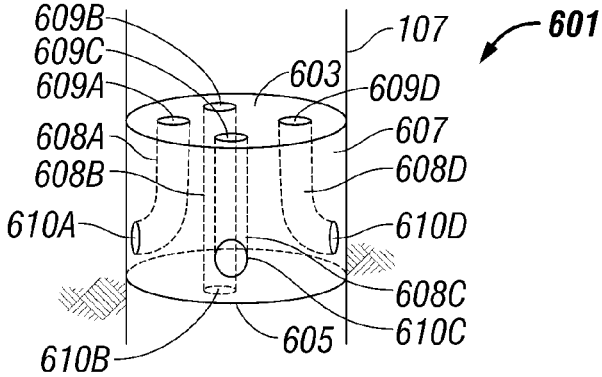
FIG. 6 is a schematic diagram of a template guide that can be used to drill the child boreholes of FIG. 4 and/or FIG. 5.

The child borehole pattern as described above is preferably formed with a template guide 601 as shown in FIG. 6. This template guide 601 is cylindrical in shape with a top surface 603 opposite a bottom surface 605 and a curved side surface 607 therebetween. A set of borehole guides (for example, four shown as 608A, 608B, 608C, 608D) extend from inlet ports (609A, 609B, 609C, 609D) on the top face surface 603 to outlet ports (610A, 610B, 610C, 610D) in the side surface 607. The drill pipe (or drill string) is inserted into the inlet port of each borehole guide and forced out the respective outlet port for guided drilling. The orientation of the drill pipe as it exits the outlet ports of the guide is designed to produce the desired child borehole pattern.

Figure 7:
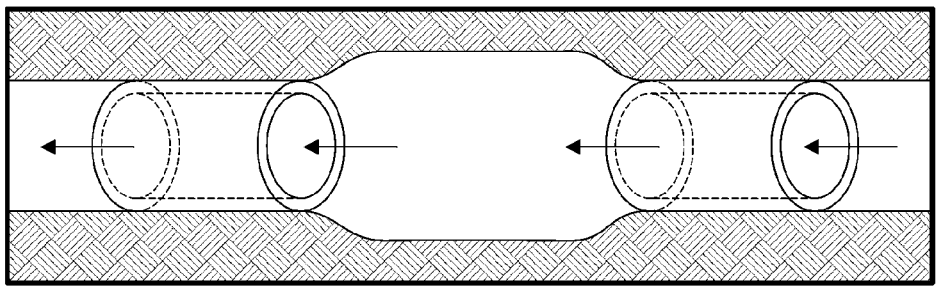
FIG. 7 is a schematic illustration of expandable support members that are deployed within the enlarged cavity formed along a borehole section and that mechanically support the walls of the enlarged cavity in accordance with the present invention.

It is also contemplated that one or more expandable support members can be deployed into the enlarged cavity(ies) formed as described herein for stability. In the preferred embodiment, the expandable member is loaded into coiled tubing in a collapsed configuration and deployed from the coiled tubing (preferably deployed from the end of a coiled tubing string) within a cavity where it expands radially into an expanded configuration that butts up against the wall of the cavity. The radial expansion of the support member can be effectuated automatically (by springs or shape memory effects of the material of the expansion members) or by hydraulic or pneumatic actuation. In the expanded configuration, the support member supports radial loads and thus provides stability to the cavity while providing a central flow path for the flow of drilling fluids and production fluids therethrough as shown in FIG. 7. Exemplary support members are shown in U.S. Pat. No. 7,191,842, incorporated herein by reference in its entirety.

The operations described above can be repeated for multiple sections of the U-tube borehole 107 to form multiple enlarged cavities along the length of the U-tube borehole 107.

The U-tube borehole with one or more enlarged cavities as described herein can be used for thermal recovery of heavy oil deposits. In one example, the U-tube borehole with one or more enlarged cavities can be used as an injector well for steam flooding and/or other vapor assisted production applications. In these applications, the enlarged cavity(ies) of the U-tube borehole provide a greater area of influence of high temperature vapor than that previously achieved by the prior art. Insulated concentric coiled tubing can be deployed in the U-tube borehole to deliver the high temperature vapor to the enlarged cavity and other injection sites therein. Other mechanisms can be used to produce or enhance the production of oil. For example, a sonic source can be deployed in or adjacent to the enlarged cavity(ies) of the borehole to aid in reducing the viscosity of nearby heavy oil deposits. In another example, exothermic reactions can be carried out in or adjacent to the enlarged cavity(ies) of the borehole to aid in reducing the viscosity of nearby heavy oil deposits.

In another example, the U-tube borehole with one or more enlarged cavities as described herein can be used as a production well for steam flooding and/or other vapor-assisted production applications. In such applications, one or more injector wells (for example, an array of U-tube boreholes) are preferably disposed above the production U-tube borehole for heating the surrounding heavy oil deposits. The enlarged cavity(ies) and possibly other parts of the production U-tube borehole are used to capture oil that is released from the formation surrounding the production U-tube borehole. In these applications, the enlarged cavity(ies) of the U-tube borehole provide a greater area of capture of the released oil than that previously achieved by the prior art.

In yet another example, the U-tube borehole with one or more enlarged cavities as described herein can be used as a well for cyclic vapor stimulation where the well is used to inject steam and/or other high temperature vapor into a surrounding heavy oil deposit for a short period of time and then returned to production. In these applications, the enlarged cavity(ies) of the U-tube borehole provide an increased area of influence of heat (during heating) and a greater area of capture of the released oil (during production) than that previously achieved by the prior art.

It is possible for the fragments that are removed from the U-tube borehole to be phase separated to thereby extract oil and water, and possibly unwanted drilling fluids, from the fragments. The resulting tailings can be used to backfill the enlarged cavity(ies) and other parts of the U-tube borehole as needed, thereby implementing a closed loop processing system for the fragments from the U-tube borehole.

The methodologies, systems and apparatus as described above can be used for other hydrocarbon applications. For example, the methods and apparatus for borehole enlargement can be used to form enlarged cavities that extend radially from a vertical borehole section or other type borehole section.

There have been described and illustrated herein methods, systems, and apparatus that are suitable for use in production of hydrocarbons from subterranean heavy oil deposits, wherein one or more subterranean cavities are formed along a length of a borehole. The cavity is preferably formed along a U-tube borehole by coiled tubing reaming operations and/or radial drilling and explosive blasting. While particular embodiments and applications of the invention have been described, it is not intended that the invention be limited thereto, as it is intended that the invention be as broad in scope as the art will allow and that the specification be read likewise. It will therefore be appreciated by those skilled in the art that yet other modifications could be made to the provided invention without deviating from its scope as claimed.

What is claimed is:

1. A method of recovering hydrocarbons from a subterranean formation comprising:

drilling a U-tube borehole that extends between two distinct surface locations; and forming at least one enlarged cavity along the length of the U-tube borehole by:

drilling a pattern of child boreholes that extend radially outward with respect to the U-tube borehole;

triggering explosive charges disposed at or near the ends of said child boreholes to form rubble around said U-tube borehole; and breaking up the rubble into fragments and carrying the fragments to the surface.

2. A method according to claim 1, wherein a number of the child boreholes overlap one another.

3. A method according to claim 1, wherein the child boreholes extend generally in a horizontal plane transverse to the central axis of a section of the U-tube borehole.

4. A method according to claim 1, wherein the child boreholes extend radially in a three dimensional pattern with respect to the central axis of a section of the U-tube borehole.

5. A method according to claim 1, wherein the child boreholes are formed with a template guide that is cylindrical in shape with a top surface opposite a bottom surface and a curved side surface therebetween, wherein a set of borehole guides extend from inlet ports on the top face surface to outlet ports in the side surface.

6. A method according to claim 5, wherein a drill member is inserted into the inlet port of a given borehole guide and forced out the outlet port of the given borehole guide for guided drilling.

7. A method according to claim 1, further comprising, while breaking up the rubble into fragments, fluidizing the fragments for ease of transport to the surface.

8. A method according to claim 1, wherein reaming is used to break up the rubble into fragments.

9. A method according to claim 8, wherein the reaming is carried out by a bidirectional reaming tool comprising two sets of cutting bits that are rotationally driven by corresponding mud motors for reaming in opposite axial directions along the U-tube borehole, each of the mud motors operated by a coiled tubing rig.

10. A system for recovering hydrocarbons from a subterranean formation comprising:

two coiled tubing rigs that are located at two distinct surface locations, the rigs for drilling a U-tube borehole that extends between the two distinct surface locations; and means for forming at least one enlarged cavity along the length of the U-tube borehole, wherein the means for forming the at least one enlarged cavity comprises:

means for drilling a pattern of child boreholes that extend radially outward with respect to the U-tube borehole, wherein explosive charges disposed at or near the ends of said child boreholes are triggered to form rubble around said U-tube borehole, and means for breaking up the rubble into fragments and carrying the fragments to the surface.

11. A system according to claim 10, wherein a number of the child boreholes overlap one another.

12. A system according to claim 10, wherein the child boreholes extend generally in a horizontal plane transverse to the central axis of a section of the U-tube borehole.

13. A system according to claim 10, wherein the child boreholes extend radially in a three dimensional pattern with respect to the central axis of a section of the U-tube borehole.

14. A system according to claim 10, further comprising a template guide for drilling the child boreholes, the template guide being cylindrical in shape with a top surface opposite a bottom surface and a curved side surface therebetween, wherein a set of borehole guides extend from inlet ports on the top surface to outlet ports in the side surface.

15. A system according to claim 14, further comprising a drill member that is inserted into the inlet port of a given borehole guide and forced out the outlet port of the given borehole guide for guided drilling.

16. A system according to claim 10, further comprising means for fluidizing the fragments for ease of transport to the surface.

17. A system according to claim 10, further comprising a reaming tool that breaks up the rubble into fragments.

18. A system according to claim 17, wherein the reaming tool comprises a bidirectional reaming tool including two sets of cutting bits that are rotationally driven by corresponding mud motors for reaming in opposite axial directions along the U-tube borehole, each of the mud motors operated by one of the two coiled tubing rigs.

* * * * *